US007794338B2

(12) United States Patent
Cherry

(10) Patent No.: US 7,794,338 B2
(45) Date of Patent: Sep. 14, 2010

(54) ROTATING PLATFORM ASSEMBLY FOR PITCHING MACHINES

(76) Inventor: Kim N. Cherry, 22345 Can Ada Rd., Star, ID (US) 83669

( * ) Notice: Subject to any disclaimer, the term of this patent is extended or adjusted under 35 U.S.C. 154(b) by 208 days.

(21) Appl. No.: 12/135,358

(22) Filed: Jun. 9, 2008

(65) Prior Publication Data

US 2008/0305894 A1 Dec. 11, 2008

Related U.S. Application Data

(60) Provisional application No. 60/942,709, filed on Jun. 8, 2007.

(51) Int. Cl.
*A63B 69/00* (2006.01)

(52) U.S. Cl. ..... 473/451; 473/431; 124/17

(58) Field of Classification Search ..... 473/422, 473/451, 431, 454; 124/6, 70, 20.1, 20.2, 124/16, 17

See application file for complete search history.

(56) References Cited

U.S. PATENT DOCUMENTS

| | | | | |
|---|---|---|---|---|
| 2,974,954 | A | | 3/1961 | Martin |
| 4,074,905 | A | | 2/1978 | High |
| 4,252,490 | A | | 2/1981 | Keller |
| 4,269,162 | A | | 5/1981 | Abraham et al. |
| 4,291,663 | A | * | 9/1981 | Buck et al. ..... 124/26 |
| 4,442,823 | A | * | 4/1984 | Floyd et al. ..... 124/78 |
| 4,524,749 | A | | 6/1985 | Giovagnoli |
| 4,714,248 | A | * | 12/1987 | Koss ..... 473/436 |
| 4,873,964 | A | | 10/1989 | Bonoan |
| 5,118,103 | A | | 6/1992 | Miller |
| 5,195,744 | A | | 3/1993 | Kapp et al. |
| 5,249,564 | A | | 10/1993 | Peachey |
| 5,303,695 | A | | 4/1994 | Shopsowitz |
| 5,383,657 | A | | 1/1995 | Rathmell |
| 5,398,665 | A | | 3/1995 | Carlson |
| 5,421,145 | A | | 6/1995 | Case et al. |
| 5,431,145 | A | | 7/1995 | Strait et al. |
| 5,439,212 | A | | 8/1995 | Hart |
| 5,464,208 | A | * | 11/1995 | Pierce ..... 473/451 |
| 5,657,984 | A | | 8/1997 | Leo |
| 5,660,386 | A | | 8/1997 | Krieger |
| 5,722,905 | A | | 3/1998 | Bidelman |
| 5,769,064 | A | | 6/1998 | Lu et al. |
| 5,776,018 | A | * | 7/1998 | Simpson et al. ..... 473/433 |
| 5,897,445 | A | | 4/1999 | Sanders |
| 5,996,565 | A | | 12/1999 | Whitmer |
| 6,004,233 | A | | 12/1999 | Raubuck et al. |
| 6,026,798 | A | | 2/2000 | Sanders |
| 6,102,021 | A | | 8/2000 | Sanders et al. |
| 6,213,574 | B1 | | 4/2001 | Pierce |

(Continued)

OTHER PUBLICATIONS

International Search Report for PCT/US2004/012927.

*Primary Examiner*—Mitra Aryanpour
(74) *Attorney, Agent, or Firm*—Stephen M. Nipper; Dykas, Shaver & Nipper, LLP

(57) ABSTRACT

A pivoting frame assembly for use with a pitching machine. The pitching machine for pitching balls. The pivoting frame assembly for supporting the pitching machine above a ground surface. The pivoting frame assembly having a first portion for supporting the pitching machine and a second portion configured for contacting a ground surface, these first and second portions pivotally connected to one another.

9 Claims, 7 Drawing Sheets

U.S. PATENT DOCUMENTS 6,276,353 B1 * 8/2001 Briggs et al. ..... 124/71
6,550,491 B1 4/2003 Bixler et al.
6,880,542 B1 * 4/2005 Johndreau et al. ..... 124/78
6,884,188 B2 * 4/2005 Cherry ..... 473/451
6,955,615 B1 10/2005 Cavell
7,413,521 B2 * 8/2008 Cherry ..... 473/451
7,648,431 B1 * 1/2010 Kinkead ..... 473/454
2008/0032828 A1 * 2/2008 Alger ..... 473/446

* cited by examiner

ROTATING PLATFORM ASSEMBLY FOR PITCHING MACHINES

PRIORITY

This application is a non-provisional claiming the priority of provisional application 60/942,709 filed on Jun. 8, 2007 entitled "Rotating Platform Assembly for Pitching Machines" with the same inventor, the disclosure of which is hereby incorporated in by reference.

FIELD OF THE INVENTION

The present invention generally relates to devices and apparatuses used to train athletes to hit a moving ball, more particularly to pitching machines configured for rotation so a coach can change the orientation of the pitching machine relative to the athlete (batter or fielder).

BACKGROUND OF THE INVENTION

Coaches frequently train athletes, namely baseball and softball players, to properly hit baseballs/softballs. Typically, a batter will spend time within a "batting cage" receiving balls pitched by a commercial pitching machine. Alternatively, portable pitching machines are known in the prior art and are utilized by coaches to pitch balls to batters. Pitching machines can also be configured for "pitching" fly balls into the air or along the ground for fielders to practice fielding skills.

SUMMARY OF THE INVENTION

The invention is a rotatable frame assembly in combination with a pitching machine having uprights and an open top container for storing balls and a seat. In the preferred embodiment, the rotatable frame assembly comprises a support frame, a pivot joint and a base frame.

The support frame for supporting the pitching machine. The support frame having an upper pivot joint connector. The support frame having a support frame first end and a support frame second end. The support frame first end comprising a first pitching machine connector (preferably a channel) configured for supporting a first end portion of the pitching machine (such as a support) and a second pitching machine connector (preferably a channel) configured for supporting a second end portion of said pitching machine (such as a support).

The pivot joint pivotally connects the support frame to the base frame.

The base frame is for contacting a ground surface. The base frame allows the support frame to pivot relative to the base frame and the ground surface. It is preferred that the pitching machine seat have a plane, wherein the pivot joint defines an axis of rotation that generally bisects the seat plane.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
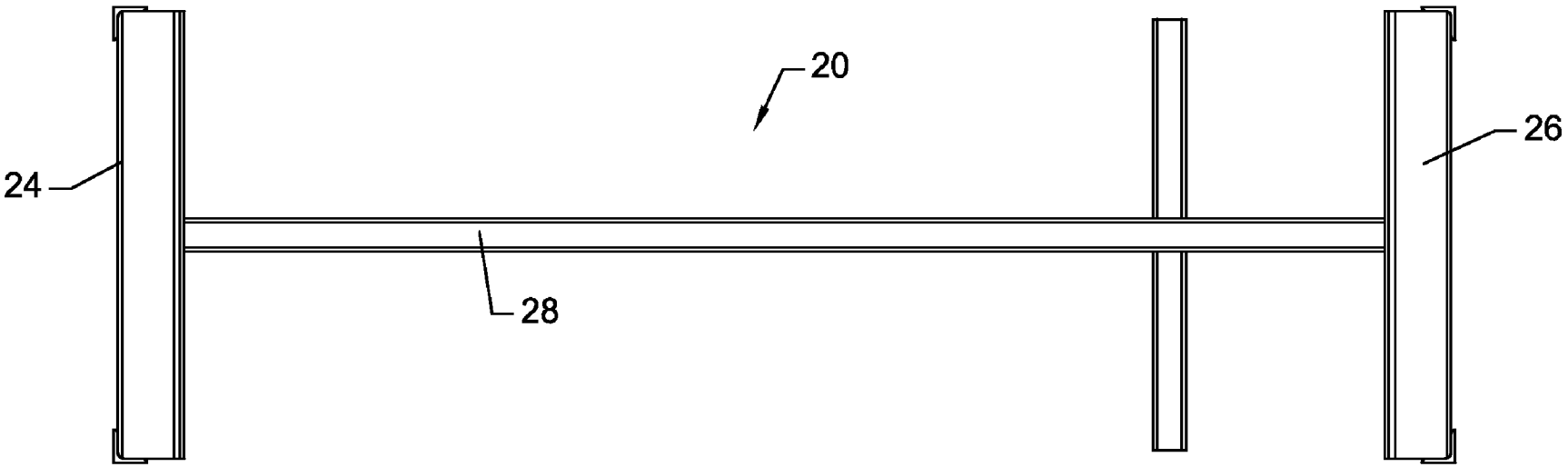
FIG. 1 is a plan view of the support frame of a first embodiment of the present invention.
Figure 2:
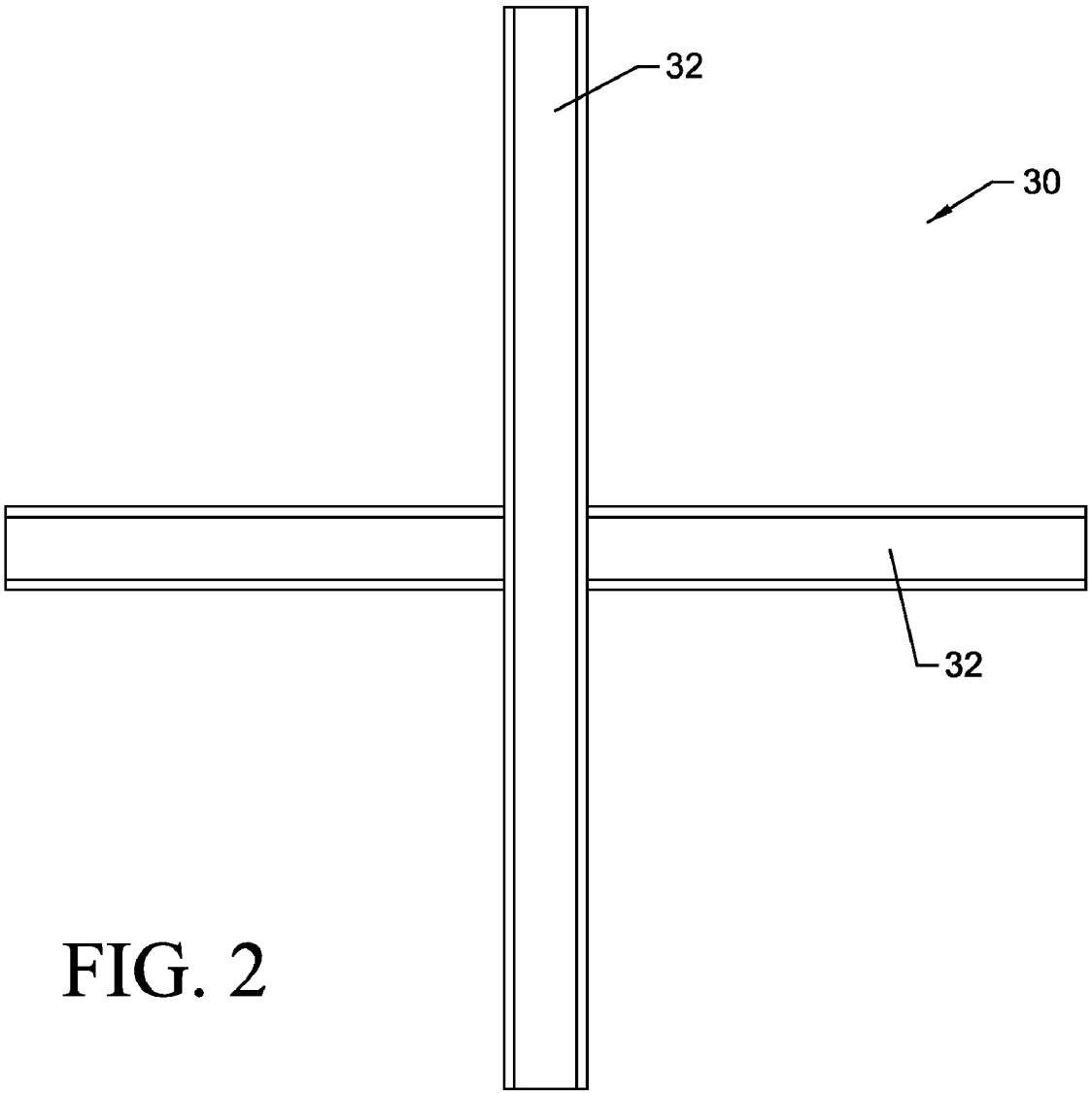
FIG. 2 a plan view of the base frame of the first embodiment of the present invention.
Figure 3:
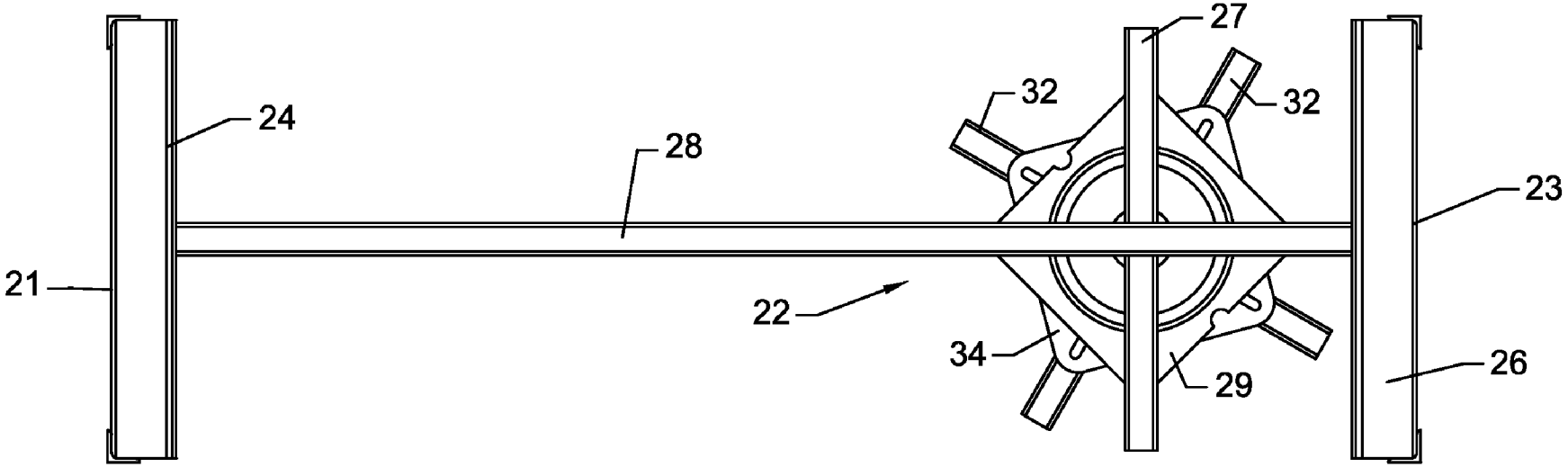
FIG. 3 is a plan view of the first embodiment of the present invention.
Figure 4:
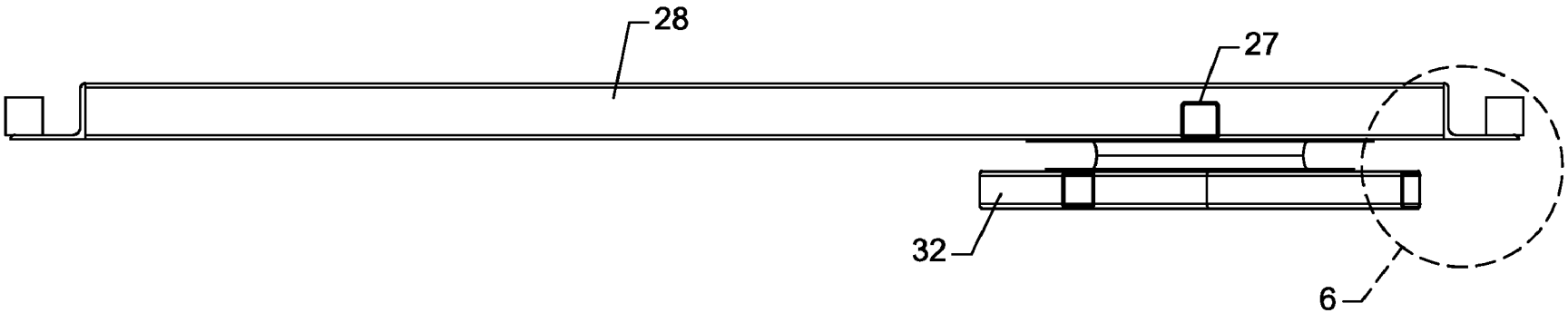
FIG. 4 is a first side view of the embodiment shown in FIG. 3.
Figure 5:
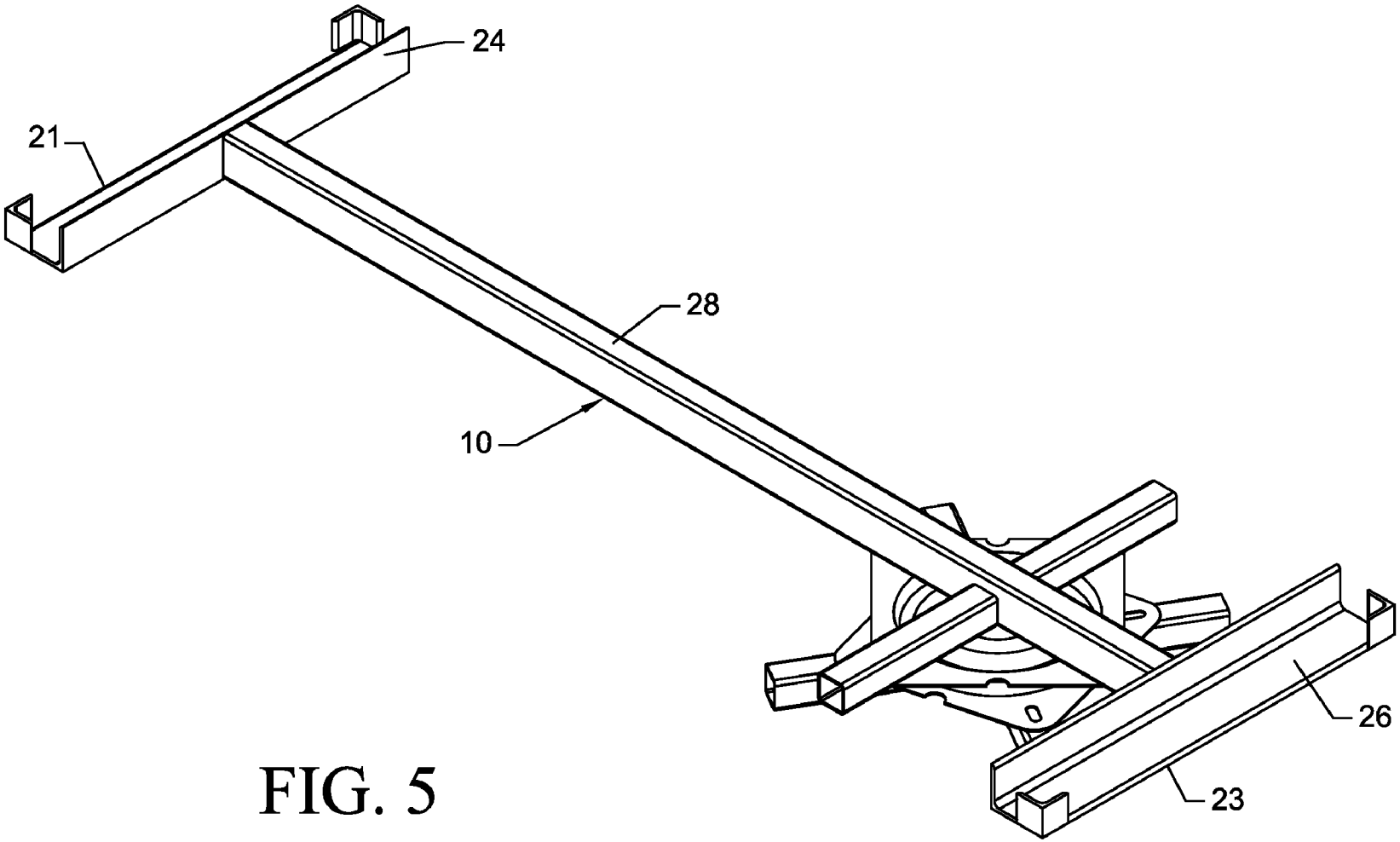
FIG. 5 is perspective view of the embodiment shown in FIG. 3.
Figure 6:
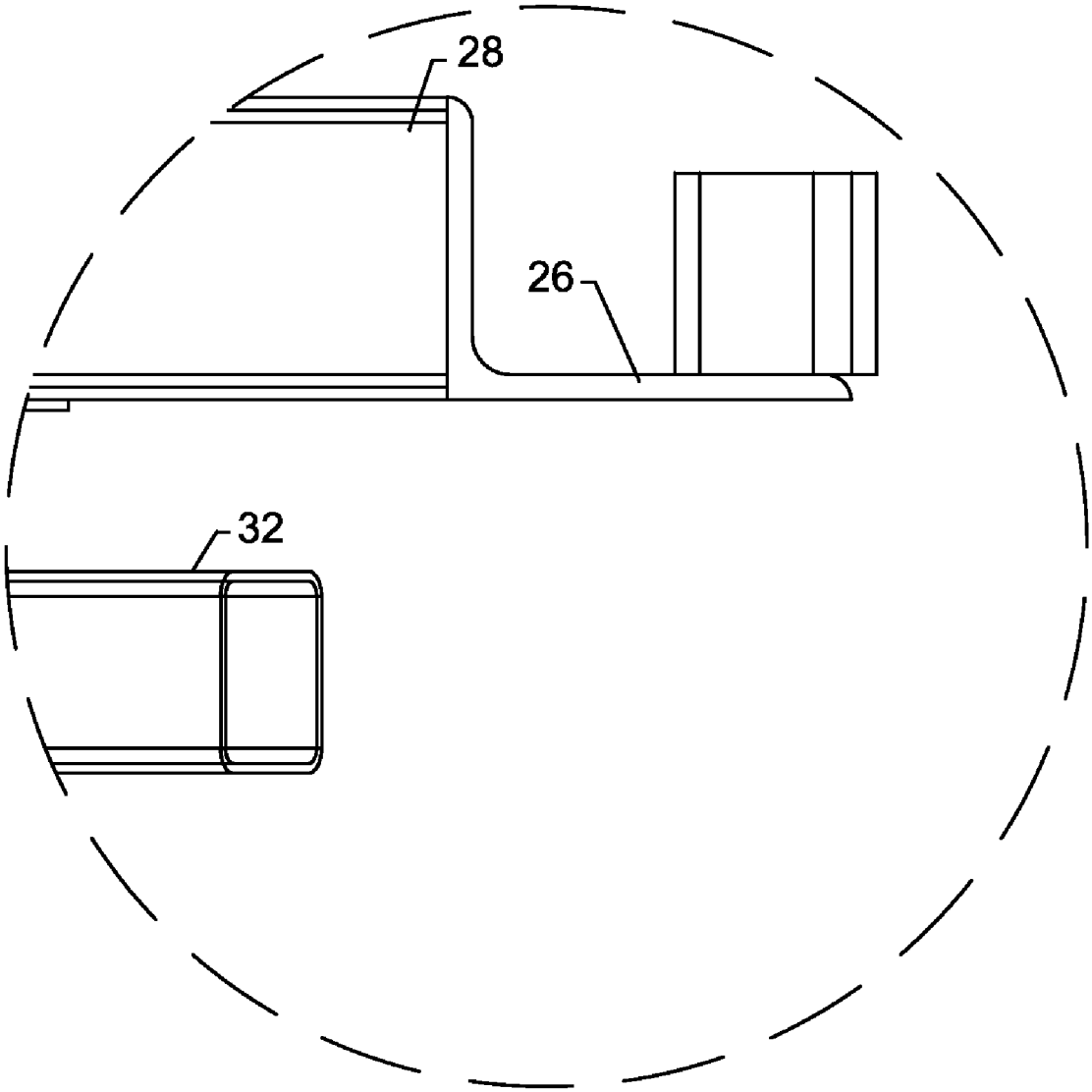
FIG. 6. is a partial, detail view of FIG. 4.
Figure 7:
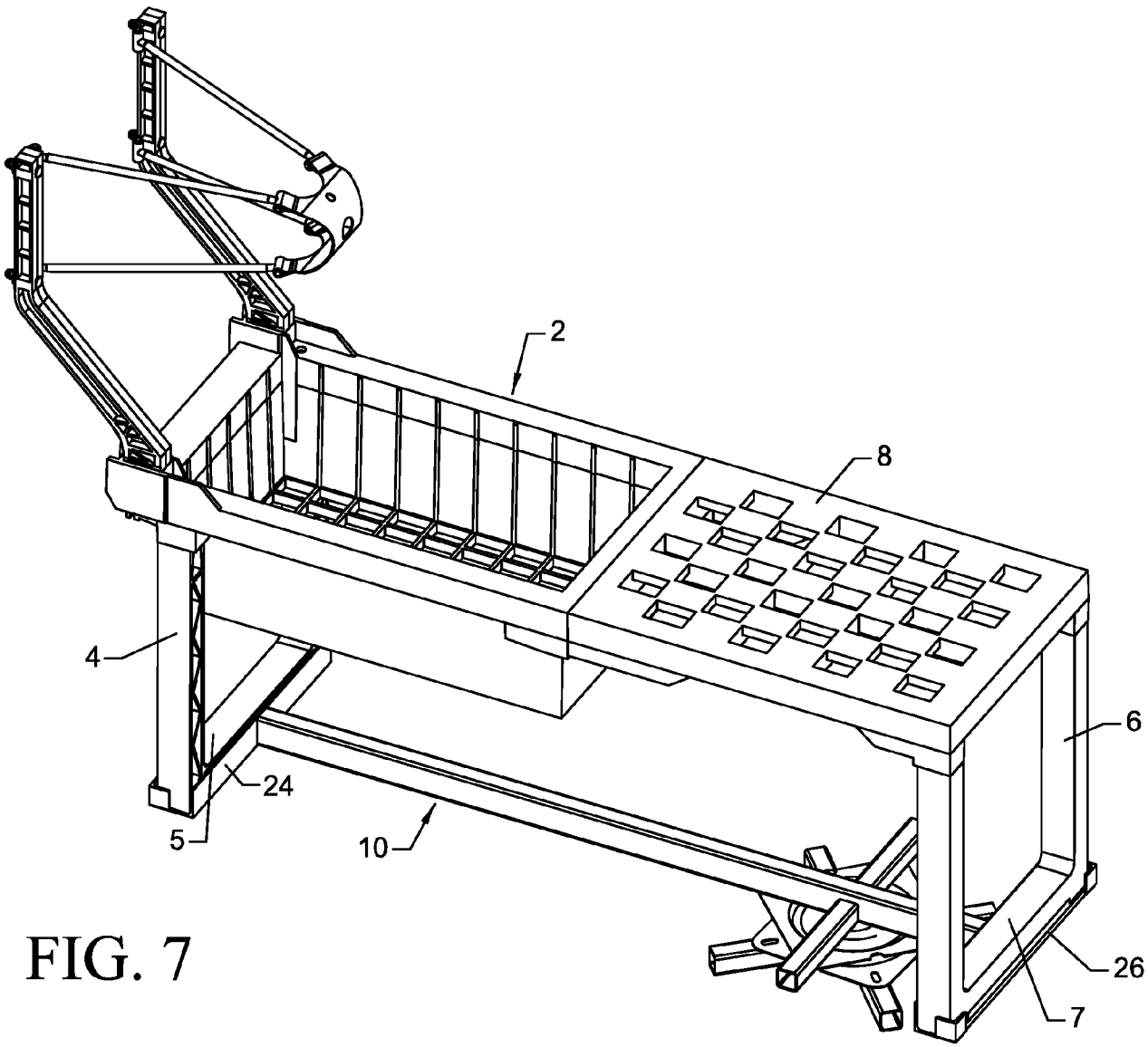
FIG. 7 is a perspective view of the embodiment of FIG. 3 shown with one embodiment of a pitching machine held thereon.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Referring to FIGS. 1-7, shown is one embodiment of the present invention. Other embodiments exist. These Figures show a rotating (pivoting) frame assembly configured for use with a pitching machine. One particular example of a pitching machine 2 that can be used with the present invention was invented by the present inventor (U.S. Pat. No. 6,884,188, the disclosure of which is incorporated herein by reference). This pitching machine 2, a representation can be seen in FIG. 7, having a first end portion 4, a support 5, a second end portion 6, a support 7 and a seat 8.

While the particular make and model of pitching machine that can be used with the embodiment of the present invention shown in the drawings is the device of U.S. Pat. No. 6,884,188, it is expressly noted that the technologies of the present invention may be applied to other types and manufactures of pitching machines and that the disclosure of this one preferred pitching machine is not intended in any way to be a limitation upon the use of the present invention.

The pivoting frame assembly 10 comprising a support frame 20 for connecting with the pitching machine and a base frame 30 pivotally connected to the support frame, the base frame configured for resting upon a ground surface.

The support frame 20 particularly shown in FIG. 1. FIG. 1 showing that the support frame 20 has a first end 21 extending to a second end 23. A center frame bar 28 extends between a first pitching machine connector 24 and a second pitching machine connector 26. In the embodiment shown, a cross bar 27 which is perpendicular to the center frame bar 28 is utilized to add stability to the support frame.

The support frame 20 having a pivot joint 22 configured for allowing the support frame 20 to pivotally connect to a base frame 30. It is preferred that this pivot joint be generally aligned (in the embodiment particularly configured for use with the device of U.S. Pat. No. 6,884,188) to be below the pitching machine's seat portion. For instance, the pitching machine seat having a plane, wherein the pivot joint defines an axis of rotation that generally bisects the seat plane.

The first pitching machine connector 24 (preferably a channel) is configured for attaching to a first portion of the bottom of the pitching machine (preferably a first end portion support), for instance the front leg assembly of the '188 patent. The second pitching machine connector 26 (preferably a channel) is configured for attaching to a second portion of the bottom of the pitching machine (preferably a second end portion support), for instance the second leg assembly of the '188 patent. Such a connection resulting in the frame assembly supporting the pitching machine.

In use, the pitching machine of the '188 patent can be set into channels defined in the first and second machine connectors, thereby connecting the pitching machine to the pivoting frame assembly. The pitching machine can be merely rested therein, or can be locked therein using any number of means, including but not limited to fasteners, elastic bands, friction fits, etc. It is preferred that the connection between the pitching machine and the pivoting frame assembly not be permanent, in that the pitching machine is thus configured for use both with or without the frame assembly.

In utilization with a different pitching machine, the support frame would preferably be configured for connecting with the base/ground contacting portion of the pitching machine, thereby supporting the pitching machine above a ground surface. To with, the support frame could be of a different shape/structure than the embodiment shown in the figures, including but not limited to being circular, parallelepipedal, triangular, having a plurality of arms extending there-from for connecting with the base/legs of the pitching machine, etc.

The base frame 30 is the portion of the present invention configured for contacting a ground surface and which is pivotally connected to the support frame 20. In the embodiment shown, the base frame 30 having a lower pivot joint connector 34 configured for cooperating with the pivot joint 22 of the support frame 20 to allow the support frame (with pitching machine attached there-to) to pivot relative to the base frame 30 and the ground surface. The pivot joint 22 interconnecting the upper pivot joint connection 29 with the lower pivot joint connection 34. Various types of pivoting connectors could be used and/or substituted for the pivot joint-pivot connector generally disclosed herein and shown in the drawings.

The base frame 30 can be configured for connection with the ground surface in any number of ways. In the embodiment shown in the drawings, a plurality of legs 32 extend radially, these legs configured for contacting the ground surface. Rubber pads or other structure may be present on these legs for protecting the surface that the frame assembly is used on and such structure may be used to add traction, thereby helping the base frame 30 to remain fixed while the support frame 20 attached there-to is able to pivot.

In use, in one embodiment, a pitching machine resting upon the pivoting frame assembly could be sat upon by a coach. The coach would then be able to easily pivot the pitching machine to the left and/or to the right, thereby allowing the coach the ability to use the pitching machine more easily for fielding practice, namely varying the location of balls "hit" to fielders. In example, the coach could fire a first ball to a first player, rotate a few degrees and fire a second ball to a second player. Another example would be firing a first ball to the left of a player, and then a second ball to the right of a player, thereby giving the player practice fielding balls thrown or hit to either side of him/her. All of this able to be done without the coach having to stand up to reposition the pitching machine.

The preferred embodiment is made from tubular steel and angle iron. Other materials may be used.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A rotatable frame assembly in combination with a pitching machine having uprights and an open top container for storing balls and a seat, said rotatable frame assembly comprising:

a support frame; a pivot joint; and a base frame;

said support frame for supporting said pitching machine, said support frame having an upper pivot joint connector, said support frame having a support frame first end and a support frame second end, said support frame first end comprising a first pitching machine connector configured for supporting a first end portion of said pitching machine, said support frame second end comprising a second pitching machine connector configured for supporting a second end portion of said pitching machine;

said pivot joint pivotally connecting said support frame to a base frame; and said base frame for contacting a ground surface, said base frame allowing said support frame to pivot relative to the base frame and the ground surface.

2. The rotatable frame assembly of claim 1, wherein the first pitching machine connector is a channel configured for receiving at least one pitching machine support.

3. The rotatable frame assembly of claim 1, wherein the second pitching machine connector is a channel configured for receiving at least one pitching machine support.

4. The rotatable frame assembly of claim 1, wherein said pitching machine seat has a plane, wherein said pivot joint defines an axis of rotation, wherein said axis of rotation generally bisects said seat plane.

5. A rotatable frame assembly in combination with a pitching machine having uprights and an open top container for storing balls and a seat, said rotatable frame assembly comprising:

a support frame; a pivot joint; and a base frame;

said support frame for supporting said pitching machine, said support frame comprising a center frame bar perpendicularly intersected by a cross bar at an intersection, said support frame having an upper pivot joint connector at said intersection, said center frame bar extending between a support frame first end and a support frame second end, said support frame first end comprising a first pitching machine connector configured for supporting a first end portion of said pitching machine, said support frame second end comprising a second pitching machine connector configured for supporting a second end portion of said pitching machine;

said pivot joint pivotally connecting said support frame upper pivot joint connector to a base frame lower pivot joint connector; and said base frame for contacting a ground surface, said base frame having a lower pivot joint connector for connecting to said pivot joint thereby allowing said support frame to pivot relative to the base frame and the ground surface, said base frame contacting said ground surface via a plurality of radially extending ground surface contacting legs.

6. The rotatable frame assembly of claim 5, wherein the first pitching machine connector is a channel configured for receiving at least one pitching machine support.

7. The rotatable frame assembly of claim 5, wherein the second pitching machine connector is a channel configured for receiving at least one pitching machine support.

8. The rotatable frame assembly of claim 5, wherein said pitching machine seat has a plane, wherein said pivot joint defines an axis of rotation, wherein said axis of rotation generally bisects said seat plane.

9. A rotatable frame assembly in combination with a pitching machine having uprights and an open top container for storing balls and a seat, said rotatable frame assembly comprising:

a support frame; a pivot joint; and a base frame;

said support frame for supporting said pitching machine, said support frame comprising a center frame bar perpendicularly intersected by a cross bar at an intersection, said support frame having an upper pivot joint connector at said intersection, said center frame bar extending between a support frame first end and a support frame second end, said support frame first end comprising a first pitching machine connector configured for supporting a first end portion of said pitching machine, said support frame second end comprising a second pitching machine connector configured for supporting a second end portion of said pitching machine;

said pivot joint pivotally connecting said support frame upper pivot joint connector to a base frame lower pivot joint connector; and said base frame for contacting a ground surface, said base frame having a lower pivot joint connector for connecting to said pivot joint thereby allowing said support frame to pivot relative to the base frame and the ground surface, said base frame contacting said ground surface via a plurality of radially extending ground surface contacting legs;

wherein the first pitching machine connector is a channel configured for receiving at least one pitching machine support, wherein the second pitching machine connector is a channel configured for receiving at least one pitching machine support, and wherein said pitching machine seat has a plane, wherein said pivot joint defines an axis of rotation, wherein said axis of rotation generally bisects said seat plane.

* * * * *